US012607347B2

(12) United States Patent
Niu et al.

(10) Patent No.: US 12,607,347 B2
(45) Date of Patent: Apr. 21, 2026

(54) TWO-CHANNEL BURNER AND METHOD OF USE THEREFOR, AND MULTI-CHANNEL SINGLE-CONE BURNER AND METHOD OF USE THEREFOR

(71) Applicant: BEIJING TIANDI RONGCHUANG TECHNOLOGY CO., LTD, Beijing (CN)

(72) Inventors: Fang Niu, Beijing (CN); Wei Luo, Beijing (CN); Naiji Wang, Beijing (CN); Renshan Ji, Beijing (CN); Liang Shi, Beijing (CN); Xing Liang, Beijing (CN); Yanyan Gong, Beijing (CN); Yanrong Wei, Beijing (CN); Pengzhong Liu, Beijing (CN); Lu Duan, Beijing (CN); Xiaojiong Li, Beijing (CN); Yuhong Cui, Beijing (CN); Xing Qiu, Beijing (CN); Nan Jia, Beijing (CN); Zhixing Wang, Beijing (CN); Xiangyu Zheng, Beijing (CN); Gang Liu, Beijing (CN); Lili Yan, Beijing (CN); Xiaolei Cheng, Beijing (CN); Zhenyu Liu, Beijing (CN); Peng Miao, Beijing (CN); Shujuan Yan, Beijing (CN); Xufang Zhang, Beijing (CN); Shijun Wang, Beijing (CN); Meijun Li, Beijing (CN); Boxi Du, Beijing (CN); Changfang Meng, Beijing (CN); Xuewen Wang, Beijing (CN); Mingshuang Cui, Beijing (CN); Jianpeng Wang, Beijing (CN); Yongying Wang, Beijing (CN); Long Chen, Beijing (CN); Zhi Dong, Beijing (CN); Haipeng Yu, Beijing (CN); Zhe Chen, Beijing (CN); Song Zhang, Beijing (CN); Huiyan Ma, Beijing (CN)

(73) Assignee: BEIJING TIANDI RONGCHUANG TECHNOLOGY CO., LTD, Beijing (CN)

( * ) Notice: Subject to any disclaimer, the term of this patent is extended or adjusted under 35 U.S.C. 154(b) by 721 days.

(21) Appl. No.: 18/002,070

(22) PCT Filed: Aug. 30, 2021

(86) PCT No.: PCT/CN2021/115434
§ 371 (c)(1),
(2) Date: Dec. 16, 2022

(87) PCT Pub. No.: WO2022/042732
PCT Pub. Date: Mar. 3, 2022

(65) Prior Publication Data

US 2023/0272906 A1 Aug. 31, 2023

(30) Foreign Application Priority Data

Aug. 31, 2020 (CN) ..... 202010895168.9
Aug. 31, 2020 (CN) ..... 202010895193.7
(Continued)

(51) Int. Cl.
*F23D 1/02* (2006.01)

(52) U.S. Cl.
CPC ..... *F23D 1/02* (2013.01); *F23D 2201/20* (2013.01)

(58) Field of Classification Search
None
See application file for complete search history.

(56) References Cited

FOREIGN PATENT DOCUMENTS

CN 101576255 11/2009
CN 101644431 2/2010
(Continued)

OTHER PUBLICATIONS

WIPO, International Search Report for PCT/CN2021/115434, Dec. 1, 2021.
(Continued)

*Primary Examiner* — Jason Lau
(74) *Attorney, Agent, or Firm* — Hodgson Russ LLP

(57) ABSTRACT

A two-channel burner includes a pulverized coal supply mechanism, a transition channel, an inner secondary air guide tube, an outer secondary air guide tube, a combustion stabilizing chamber, and a flow smoothing chamber. The outer secondary air guide tube, the combustion stabilizing chamber, and the flow smoothing chamber are sequentially
(Continued)

connected to form a burner body. The pulverized coal supply mechanism passes through an interior of the burner body. The transition channel is fitted over the pulverized coal supply mechanism. The inner secondary air guide tube is disposed between the transition channel and the outer secondary air guide tube and forms an inner secondary air passage together with the transition channel, and forms an outer secondary air passage together with the outer secondary air guide tube. An outlet end of the inner secondary air guide tube is formed to have a flared opening.

20 Claims, 13 Drawing Sheets

(30) Foreign Application Priority Data

| | | |
|---|---|---|
| Aug. 31, 2020 | (CN) | 202010896256.0 |
| Aug. 31, 2020 | (CN) | 202010896271.5 |
| Aug. 31, 2020 | (CN) | 202021857105.6 |
| Aug. 31, 2020 | (CN) | 202021858246.X |
| Aug. 31, 2020 | (CN) | 202021858248.9 |
| Aug. 31, 2020 | (CN) | 202021858293.4 |

(56) References Cited

FOREIGN PATENT DOCUMENTS

| | | |
|---|---|---|
| CN | 101846315 | 9/2010 |
| CN | 105864759 | 8/2016 |
| CN | 206274163 | 6/2017 |
| CN | 107575861 | 1/2018 |
| CN | 207514904 | 6/2018 |
| CN | 212657705 | 3/2021 |

OTHER PUBLICATIONS

CNIPA, First Office Action for CN Application No. 202010895168.9, Oct. 9, 2024.

CNIPA, First Office Action for CN Application No. 202010896271.5, Dec. 4, 2024.

TWO-CHANNEL BURNER AND METHOD OF USE THEREFOR, AND MULTI-CHANNEL SINGLE-CONE BURNER AND METHOD OF USE THEREFOR

CROSS-REFERENCE TO RELATED APPLICATIONS

This application is a U.S. national stage entry of International Application No. PCT/CN2021/115434, filed on Aug. 30, 2021, which claims priority to Chinese Patent Application Serial Nos. 202021857105.6, 202021858293.4, 202021858248.9, 202010896256.0, 202021858246.X, 202010895168.9, 202010895193.7, and 202010896271.5, filed on Aug. 31, 2020. The entire disclosures of the above-identified applications are incorporated herein by reference.

FIELD

The present disclosure relates to a field of pulverized coal burners, and more particularly, to a two-channel burner and a method for using the same, and a multi-channel single-cone burner and a method for using the same.

BACKGROUND

At present, in the field of industrial boilers for pulverized coal, there are many kinds of burners, such as bluff body burners, swirl burners and reverse injection burners. The common point among them is that a high-temperature backflow zone is used as an ignition source to ignite a pulverized coal flow, to achieve a purpose of efficient and low nitrogen combustion of pulverized coal. However, due to the intense combustion of pulverized coal in the burner, the temperature inside the burner may reach more than 1100° C., and the burner will be in a high-temperature combustion zone for a long time, which may result in high-temperature hot corrosion. Moreover, compared with chain grate boilers and circulating fluidized bed boilers, pulverized coal industrial boilers have a narrow load regulation range and a low burnout rate during low-load operation.

SUMMARY

A two-channel burner according to a first aspect of the present disclosure includes: a pulverized coal supply mechanism, a transition channel, an inner secondary air guide tube, an outer secondary air guide tube, a combustion stabilizing chamber and a flow smoothing chamber. The outer secondary air guide tube, the combustion stabilizing chamber and the flow smoothing chamber are sequentially connected to form a burner body, the pulverized coal supply mechanism runs through the burner body, and the transition channel is fitted over an inlet end of the pulverized coal supply mechanism; the inner secondary air guide tube is arranged between the transition channel and the outer secondary air guide tube, an inner secondary air passage is formed between the inner secondary air guide tube and the transition channel, and an outer secondary air passage is formed between the inner secondary air guide tube and the outer secondary air guide tube; and meanwhile, an outlet end of the inner secondary air guide tube forms a flared opening, the flared opening has a same angle as the combustion stabilizing chamber, and a direction of an outlet end of the inner secondary air passage is parallel to a wall surface of the combustion stabilizing chamber.

A method for using a two-channel burner is provided according to a second aspect of the present disclosure. The two-channel burner includes: a pulverized coal supply mechanism, a transition channel, an inner secondary air guide tube, an outer secondary air guide tube, a combustion stabilizing chamber and a flow smoothing chamber. The outer secondary air guide tube, the combustion stabilizing chamber and the flow smoothing chamber are sequentially connected to form a burner body, the pulverized coal supply mechanism runs through the burner body, and the transition channel is fitted over an inlet end of the pulverized coal supply mechanism; the inner secondary air guide tube is arranged between the transition channel and the outer secondary air guide tube, an inner secondary air passage is formed between the inner secondary air guide tube and the transition channel, and an outer secondary air passage is formed between the inner secondary air guide tube and the outer secondary air guide tube; and meanwhile, an outlet end of the inner secondary air guide tube forms a flared opening, the flared opening has a same angle as the combustion stabilizing chamber, and a direction of an outlet end of the inner secondary air passage is parallel to a wall surface of the combustion stabilizing chamber. The pulverized coal supply mechanism includes an air-pulverized coal duct and a rich/lean separator; the air-pulverized coal duct is on a central axis of the burner body and in connection with the combustion stabilizing chamber; and the rich/lean separator is detachably connected to the air-pulverized coal duct to make pulverized coal fed into the combustion stabilizing chamber present an inner rich and outer lean concentration distribution or an inner lean and outer rich concentration distribution. The method includes the following steps. 1) Air enters the burner body in two ways, one of which passes through the movable axial impeller assembly and the inner secondary air passage, so that rotating inner secondary air with a tangential velocity is formed and directly enters the combustion stabilizing chamber, and the inner secondary air passage and the transition channel work together to form a nested high-temperature backflow zone. 2) Meanwhile, an airflow entrained with pulverized coal enters the high-temperature backflow zone through a backflow passage formed by the air-pulverized coal duct and the backflow cap, and the pulverized coal presents an inner lean and outer rich concentration distribution. The pulverized coal is preheated to 900-1000° C. through the high-temperature backflow zone. The pulverized coal is pyrolyzed in the low-oxygen and hot high-temperature backflow zone and is mixed with the inner secondary air at the closed end of the transition channel to form a main flame. The pulverized coal airflow is swirled and incinerated in the burner body. 3) The other way passes through the outer secondary air passage, to form outer secondary air. A part of the outer secondary air passes through the flared opening of the outer secondary air guide tube 4 and forms a cooling air layer flowing along the wall surface of the combustion stabilizing chamber to cool the combustion stabilizing chamber and the flow smoothing chamber, so that a wall temperature of the combustion stabilizing chamber and the flow smoothing chamber is lower than 40° C. Another part of the outer secondary air and the main flame form a high-speed jet flame wrapped in air, by the flow smoothing chamber, and the high-speed jet flame enters a furnace.

A multi-channel single-cone burner according to a third aspect of the present disclosure includes a pulverized coal supply mechanism, a transition channel, a multi-stage air distribution assembly, a guide plate, a combustion stabilizing chamber, and a flow smoothing chamber. The multi-stage air distribution assembly includes N air guide tubes arranged coaxially from inside to outside, and N is a natural number not less than two, in which the $N^{th}$ air tube is connected to the combustion stabilizing chamber and the flow smoothing chamber sequentially to form a burner body. The pulverized coal supply mechanism runs through an interior of the burner body, the transition channel is fitted over an inlet end of the pulverized coal supply mechanism, and the first air guide tube is fitted over and spaced apart from the transition channel, so that a total of N air inlet channels are formed between every adjacent two air guide tubes and between the first air guide tube and the transition channel. Meanwhile, except for the $N^{th}$ air guide tube, each of the other air guide tubes has a double-layer hollow structure, i.e., an annular groove extending axially is on an inner side of each of the other air guide tubes, and a first end of at least one guide plate is inserted into the annular groove of the corresponding air guide tube and is fixed. Thus, at least one straight flow channel is formed between each guide plate and the combustion stabilizing chamber, and a second end of each guide plate is formed with a flared opening that has a same angle as the combustion stabilizing chamber, so that a direction of an outlet end of the straight flow channel is parallel to a wall surface of the combustion stabilizing chamber.

DETAILED DESCRIPTION

Figure 1:
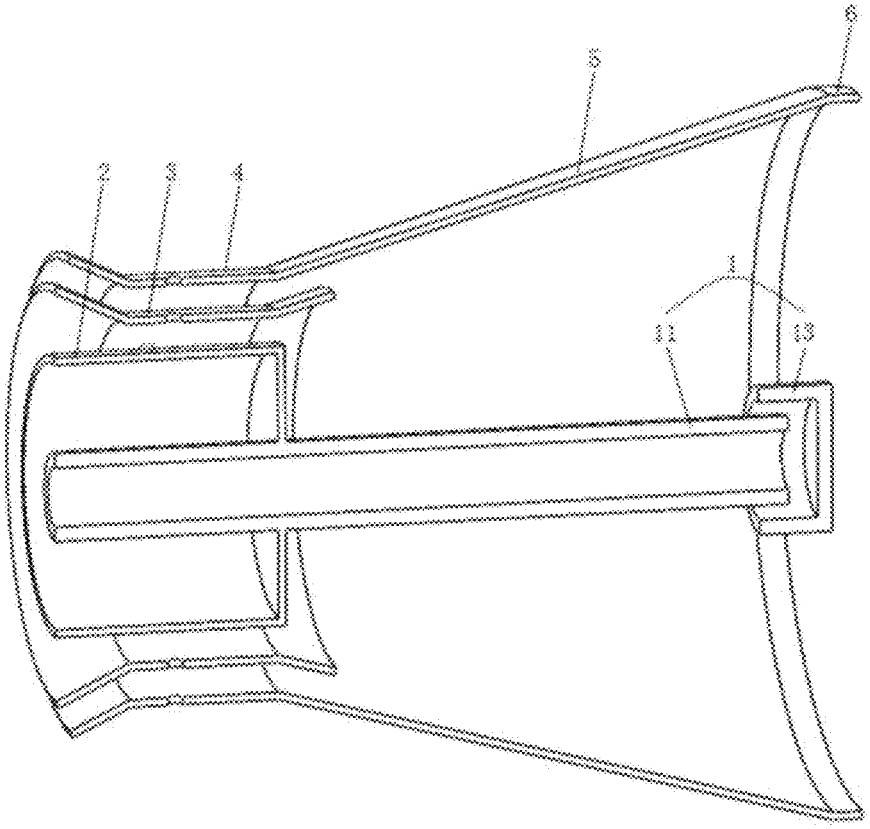
FIG. 1 is a three-dimensional longitudinal sectional view of a two-channel burner according to an embodiment of the present disclosure.

Embodiments of the present disclosure are described in detail below, and examples of the embodiments are shown in the accompanying drawings. The embodiments described below with reference to the accompanying drawings are exemplary and are intended to explain the present disclosure rather than limit the present disclosure. In the specification, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to orientations or positions as shown in the drawings under discussion. These relative terms are for convenience of description and do not indicate or imply that the device or element referred to must have a particular orientation or be constructed and operated in a particular orientation. Thus, these terms should not be construed as limitations on the present disclosure.

As shown in FIGS. 1-11, a two-channel burner according to the present disclosure includes a pulverized coal supply mechanism 1, a transition channel 2, an inner secondary air guide tube 3, an outer secondary air guide tube 4, a combustion stabilizing chamber 5 and a flow smoothing chamber 6. Among them, the outer secondary air guide tube 4, the combustion stabilizing chamber 5 and the flow smoothing chamber 6 are sequentially connected to form a burner body. The pulverized coal supply mechanism 1 runs through the burner body, and the transition channel 2 is fitted over an inlet end of the pulverized coal supply mechanism 1. The inner secondary air guide tube 3 is arranged between the transition channel 2 and the outer secondary air guide tube 4. An inner secondary air passage is formed between the inner secondary air guide tube 3 and the transition channel 2, and an outer secondary air passage is formed between the inner secondary air guide tube 3 and the outer secondary air guide tube 4. Meanwhile, an outlet end of the inner secondary air guide tube 3 forms a flared opening, and the flared opening has a same angle as the combustion stabilizing chamber 5, so that a direction of an outlet end of the inner secondary air passage is parallel to a wall surface of the combustion stabilizing chamber 5.

Figure 2:
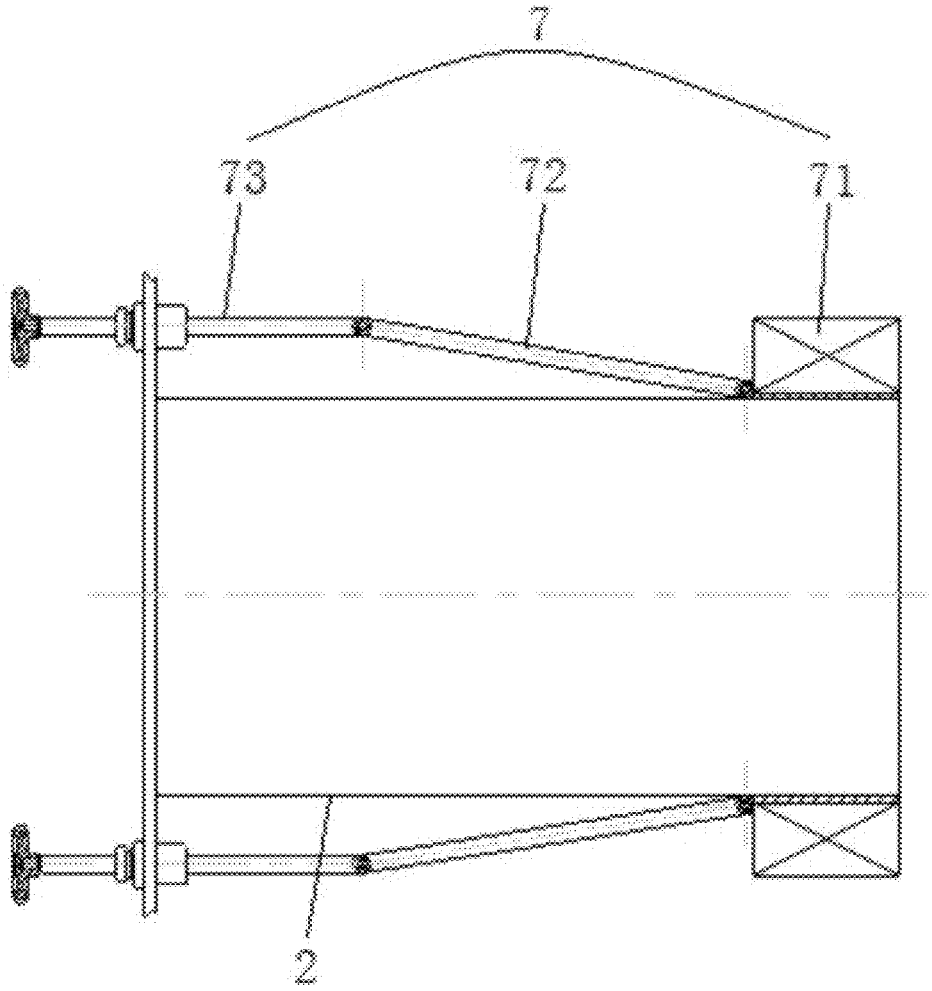
FIG. 2 is a schematic view of a movable axial impeller assembly of a two-channel burner according to an embodiment of the present disclosure.

In some embodiments, as shown in FIG. 2, a movable axial impeller assembly 7 is arranged in the inner secondary air passage, to enable inner secondary air to pass through the movable axial impeller assembly 7 and form a rotating airflow with a tangential velocity.

In some embodiments, the movable axial impeller assembly 7 includes: an axial impeller 71, which is arranged in the inner secondary air passage along a peripheral direction and is movable in an axial direction; an adjustable telescopic pull rod 72 having a first end connected to the axial impeller 71 through a first hinge joint; and a locking pull rod 73 connected to a second end of the adjustable telescopic pull rod 72 through a second hinge joint. Therefore, the axial impeller 71 can be moved axially to enter and exit the inner secondary air passage by pushing and pulling the locking pull rod 73, and the hinge joints can ensure smooth movement of the axial impeller 71.

Figure 3:
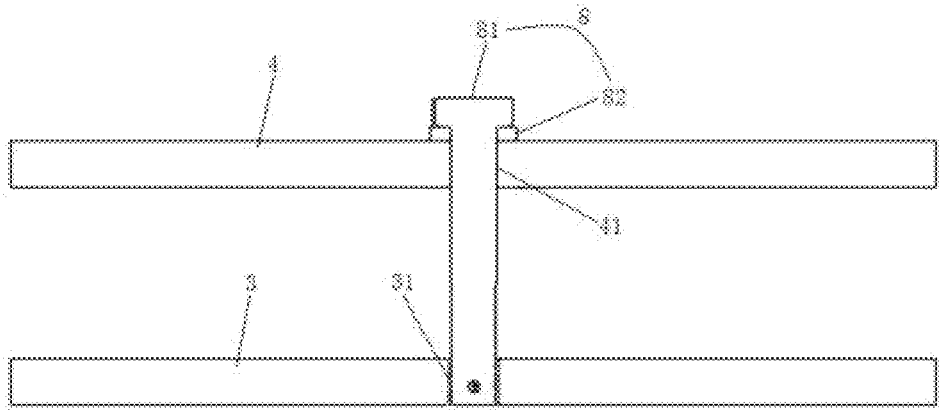
FIG. 3 is a schematic view of a movable positioning assembly of a two-channel burner according to an embodiment of the present disclosure.

In some embodiments, as shown in FIG. 3, the inner secondary air guide tube 3 and the outer secondary air guide tube 4 are connected by several movable positioning assemblies 8 distributed along the peripheral direction, and the movable positioning assemblies 8 are used to adjust a sectional area of the outer secondary air passage.

In some embodiments, there are several threaded holes 31 in an upper edge of the inner secondary air guide tube 3 along the peripheral direction and several smooth holes 41 in an upper edge of the outer secondary air guide tube 4 along the peripheral direction, and the outer secondary air guide tube 4 has a flexible tube wall. Meanwhile, the movable positioning assembly 8 mainly includes an adjusting bolt 81 and a sealing washer 82. The adjusting bolt 81 is threaded to the threaded hole 31 of the inner secondary air guide tube 3 after passing through the sealing washer 82 and the smooth hole 41 of the outer secondary air guide tube 4. As a result, the tube wall of the outer secondary air guide tube 4 is deformed by screwing in or out the adjusting bolt 81, and the sectional area of the outer secondary air passage is adjusted.

In some embodiments, as shown in FIG. 1, the pulverized coal supply mechanism 1 mainly includes an air-pulverized coal duct 11 and a backflow cap 13; the air-pulverized coal duct 11 is on a central axis of the burner body; and the backflow cap 13 is at an outlet end of the air-pulverized coal duct 11 and in an outlet section of the combustion stabilizing chamber 5.

Figure 5:
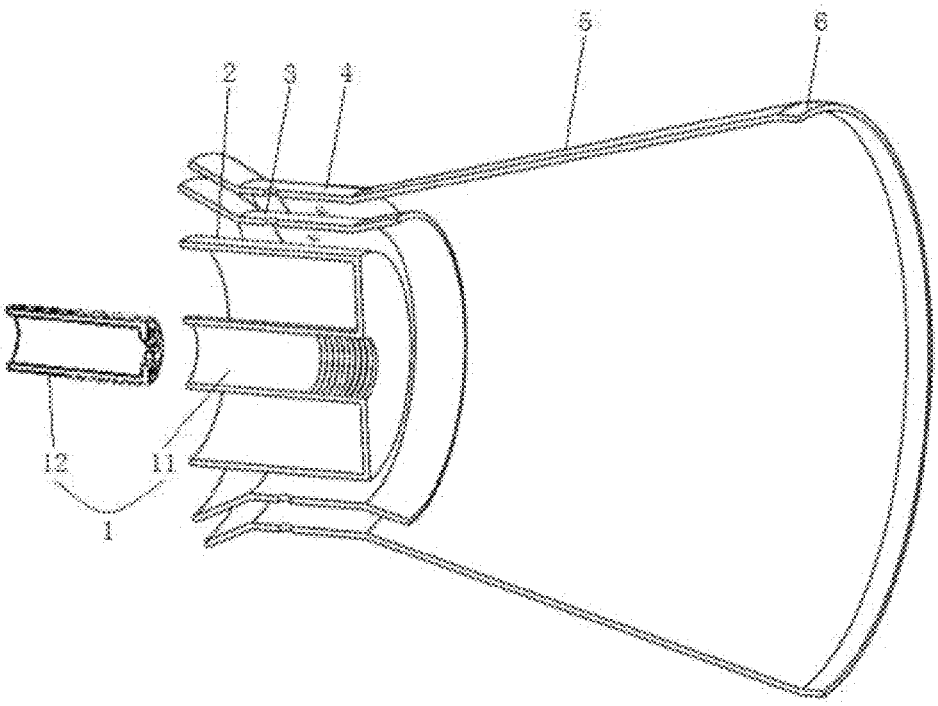
FIG. 5 is a three-dimensional longitudinal sectional view of a two-channel burner according to another embodiment of the present disclosure.
Figure 6:
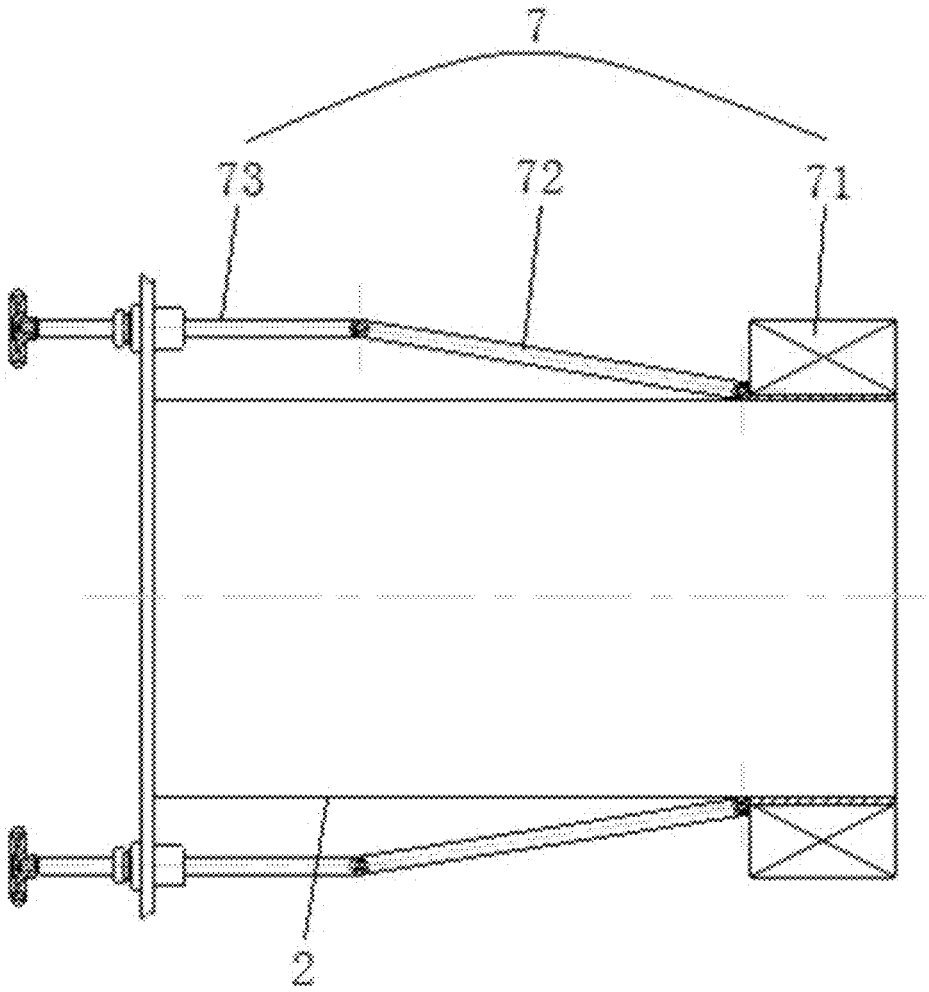
FIG. 6 is a schematic view of a movable axial impeller assembly of a two-channel burner according to an embodiment of the present disclosure.
Figure 7:
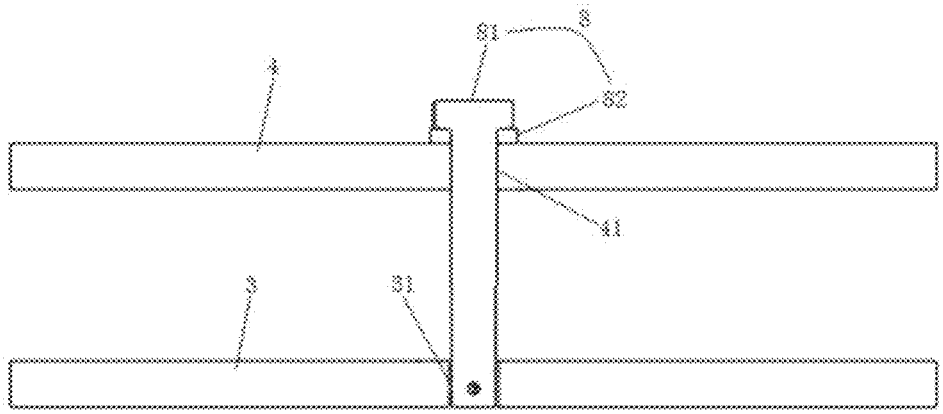
FIG. 7 is a schematic view of a movable positioning assembly of a two-channel burner according to an embodiment of the present disclosure.

Further, the structure of the pulverized coal supply mechanism 1 is not limited to that shown in FIG. 1. For example, as shown in FIG. 5, the pulverized coal supply mechanism 1 can also include the air-pulverized coal duct 11 and a rich/lean separator 12; the air-pulverized coal duct 11 is on the central axis of the burner body and in connection with the combustion stabilizing chamber 5; the rich/lean separator 12 is detachably connected to the air-pulverized coal duct 11 to make the pulverized coal fed into the combustion stabilizing chamber 5 present an inner rich and outer lean concentration distribution or an inner lean and outer rich concentration distribution.

Figure 8:
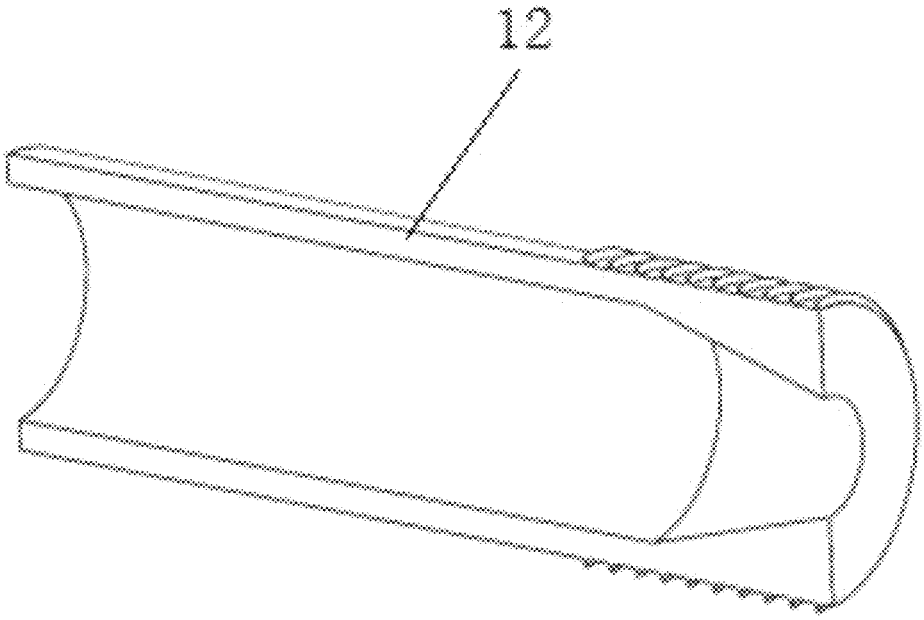
FIG. 8 is a schematic view of a throat-type rich/lean separator of a two-channel burner according to an embodiment of the present disclosure.
Figure 9:
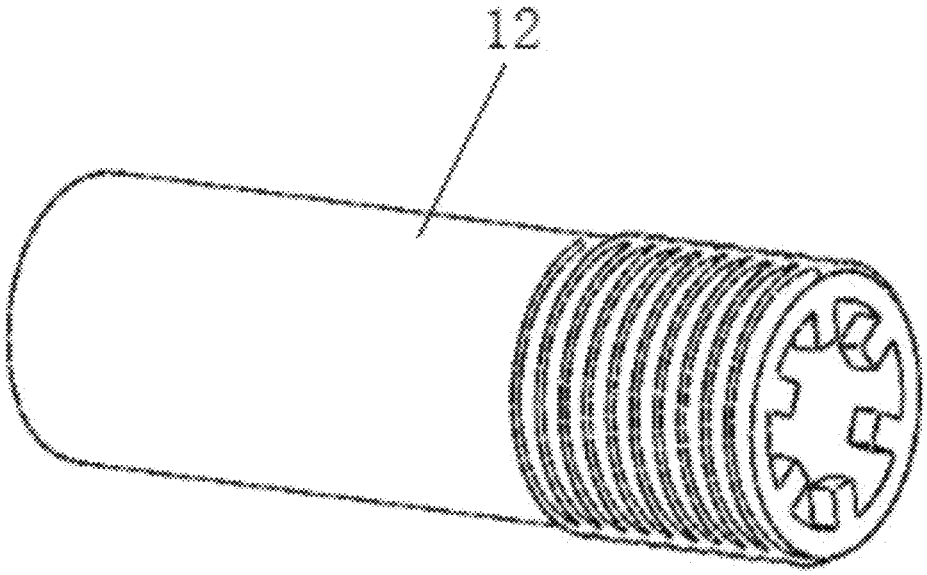
FIG. 9 is a schematic view of a gear-type rich/lean separator of a two-channel burner according to an embodiment of the present disclosure.
Figure 10:
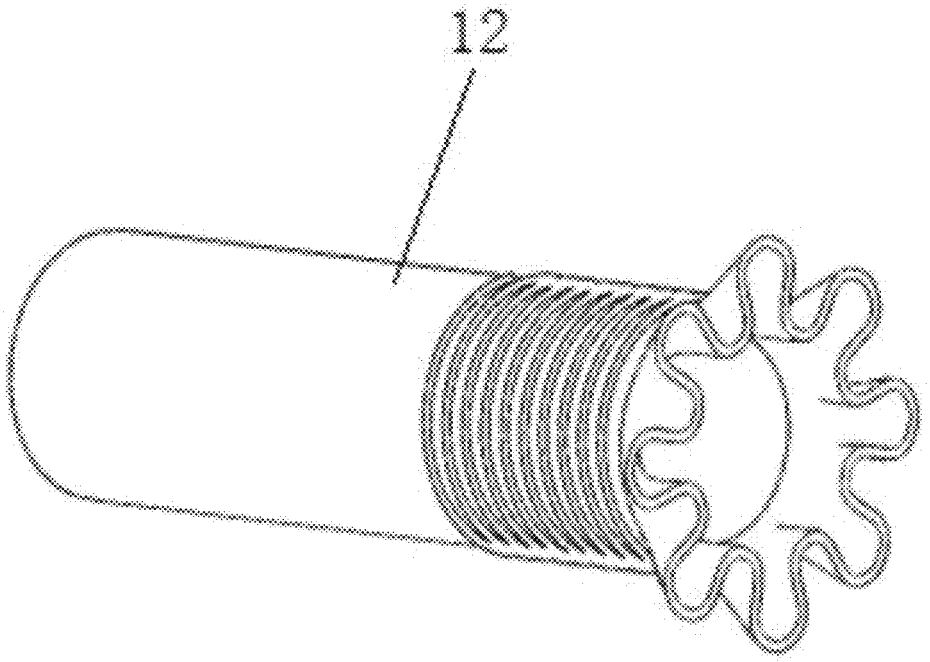
FIG. 10 is a schematic view of a petal-shaped rich/lean separator of a two-channel burner according to an embodiment of the present disclosure.
Figure 11:
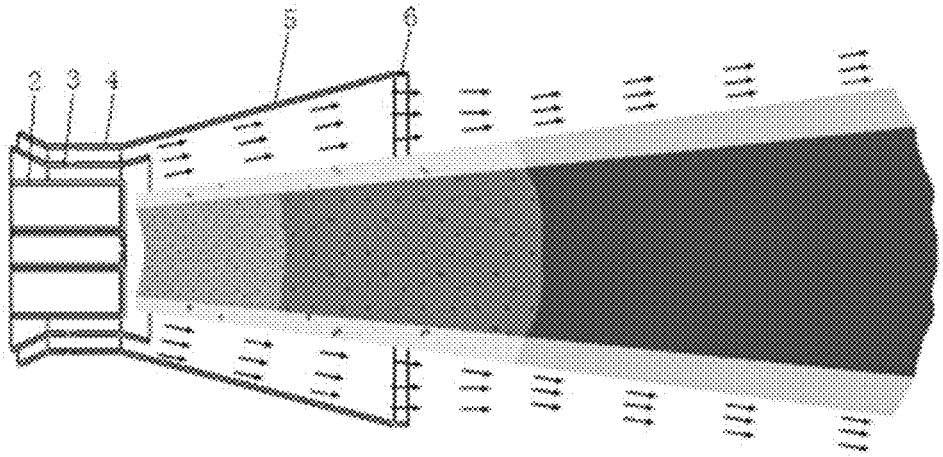
FIG. 11 is a schematic view of an internal flow field of a two-channel burner according to an embodiment of the present disclosure.

In some embodiments, the rich/lean separator 12 may be a throat-type rich/lean separator (as shown in FIG. 8), a gear-type rich/lean separator (as shown in FIG. 9), or a petal-shaped rich/lean separator (as shown in FIG. 10). An external thread is formed on an outer wall of the rich/lean separator 12, and an internal thread is formed on an inner wall of an outlet section of the air-pulverized coal duct 11. The rich/lean separator 12 can be inserted into the air-pulverized coal duct 11 through the outlet end of the air-pulverized coal duct 11 and threadedly connected to the air-pulverized coal duct 11. Consequently, the rich/lean separator 12 can be replaced correspondingly according to coal types, which broadens a load regulation range of the burner and improves the adaptability to the coal types.

In some embodiments, the transition channel 2 is a cylindrical structure with an open end and a closed end; the air-pulverized coal duct 11 penetrates the closed end of the transition channel 2 and then extends into the burner body; an igniter and/or a flame detector (not shown in the drawings) can be mounted in the transition channel 2.

In some embodiments, the transition channel 2 is conical, elliptical, cylindrical or any other curved bluff body, and the widest diameter of the transition channel 2 is smaller than an inner diameter of the inner secondary air guide tube 3 and the narrowest diameter greater thereof is greater than a maximum diameter of the igniter and/or the flame detector.

In some embodiments, several through-holes (not shown in the drawings) are provided in the combustion stabilizing chamber 5 to avoid deformation of the combustion stabilizing chamber 5 due to accidental overheating of the combustion stabilizing chamber 5.

Based on the two-channel burner according to the above embodiment, the present disclosure also provides a method for using the two-channel burner when the pulverized coal supply mechanism 1 mainly includes the air-pulverized coal duct 11 and the backflow cap 13. The method includes the following steps.

Figure 4:
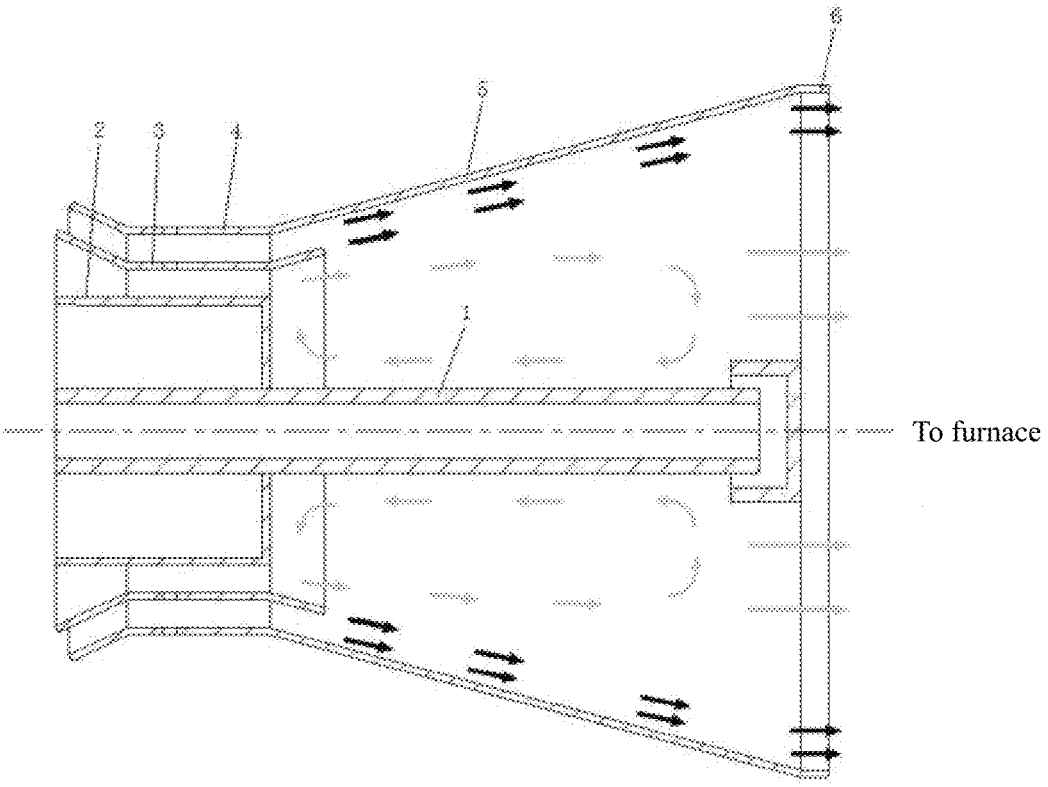
FIG. 4 is a schematic view of an internal flow field of a two-channel burner according to an embodiment of the present disclosure.

1) As shown in FIG. 4, air enters the burner body in two ways, one of which passes through the movable axial impeller assembly 7 and the inner secondary air passage, so that rotating inner secondary air with a tangential velocity is formed and directly enters the combustion stabilizing chamber 5, and the inner secondary air passage and the transition channel 2 work together to form a nested high-temperature backflow zone.
2) Meanwhile, an airflow entrained with pulverized coal enters the high-temperature backflow zone through a backflow passage formed by the air-pulverized coal duct 11 and the backflow cap 13, and the pulverized coal presents an inner lean and outer rich concentration distribution. The pulverized coal is preheated to 900-1000° C. through the high-temperature backflow zone. The pulverized coal is pyrolyzed in the low-oxygen and hot high-temperature backflow zone and is mixed with the inner secondary air at the closed end of the transition channel 2 to form a main flame. The pulverized coal airflow is swirled and incinerated in the burner body.
3) The other way passes through the outer secondary air passage, to form outer secondary air. A part of the outer secondary air passes through the flared opening of the outer secondary air guide tube 4 and forms a cooling air layer flowing along the wall surface of the combustion stabilizing chamber 5 to cool the combustion stabilizing chamber 5 and the flow smoothing chamber 6, so that a wall temperature of the combustion stabilizing chamber 5 and the flow smoothing chamber 6 is lower than 40° C. Another part of the outer secondary air and the main flame form a high-speed jet flame wrapped in air, by the flow smoothing chamber 6, and the high-speed jet flame enters a furnace, which not only stabilizes the combustion of the pulverized coal, but also avoids the occurrence of ash deposition and coking in the burner body and the furnace.

In the above embodiments, based on the two-channel burner according to the above embodiment, the present disclosure also provides a method for using the two-channel burner when the pulverized coal supply mechanism 1 includes the air-pulverized coal duct 11 and the rich/lean separator 12. The method includes the following steps.

1) A corresponding rich/lean separator 12 is selected and mounted on the air-pulverized coal duct 11 according to a coal type.
2) Air enters the burner body in two ways, one of which passes through the movable axial impeller assembly 7 and the inner secondary air passage, so that rotating inner secondary air with a tangential velocity is formed and directly enters the combustion stabilizing chamber 5, and the inner secondary air passage and the transition channel 2 work together to form a nested high-temperature backflow zone.
3) Meanwhile, an airflow entrained with pulverized coal is injected into the combustion stabilizing chamber 5 through the air-pulverized coal duct 11 and the rich/lean separator 12. The pulverized coal presents an inner rich and outer lean concentration distribution or an inner lean and outer rich concentration distribution. The pulverized coal is preheated to 900-1000° C. through the high-temperature backflow zone. The pulverized coal is pyrolyzed in the low-oxygen and hot high-temperature backflow zone and is mixed with the inner secondary to form a main flame.
4) The other way passes through the outer secondary air passage, to form outer secondary air. A part of the outer secondary air passes through the flared opening of the outer secondary air guide tube 4 and forms a cooling air layer flowing along the wall surface of the combustion stabilizing chamber 5 to cool the combustion stabilizing chamber 5 and the flow smoothing chamber 6, so that a wall temperature of the combustion stabilizing chamber 5 and the flow smoothing chamber 6 is lower than 40° C. Another part of the outer secondary air and the main flame form a high-speed jet flame wrapped in air, by the flow smoothing chamber 6, and the high-speed jet flame enters a furnace, which not only stabilizes the combustion of the pulverized coal, but also avoids the occurrence of ash deposition and coking in the burner body and the furnace.

In some embodiments, in the above step 1), in case of coal with high volatility and high calorific value, a throat-type rich/lean separator or a gear-type rich/lean separator is selected as the rich/lean separator 12, to produce an inner rich and outer lean concentration distribution of the pulverized coal, and enhance the rigidity of the main flame, thus increasing a flame length of the main flame, which is beneficial to improving combustion efficiency and reducing nitrogen oxide emissions; in case of coal with low volatility and low calorific value, a petal-shaped rich/lean separator is selected as the rich/lean separator 12, so that an inner lean and outer rich concentration distribution of the pulverized coal is produced, and several small high-temperature flue gas return zones are formed near an outlet of the petal-shaped rich/lean separator, which is helpful for the ignition and stable combustion of the pulverized coal.

In some embodiments, in the above steps, the swirling number of the rotating airflow generated by the movable axial impeller assembly 7 is controlled in a range of 0 to 2.

In some embodiments, in the above steps, the sectional area of the outer secondary air passage can be adjusted by the movable positioning assembly 8, and hence a velocity of the outer secondary air can be adjusted; moreover, a mixing rate of the inner secondary air and the outer secondary air is controlled, to control a combustion process of the pulverized coal airflow in the burner body. In such a way, an environment with low oxygen and high temperature inside and with high oxygen and low temperature outside can be formed in the combustion stabilizing chamber 5, which not only has an effect of high efficiency and low nitrogen, but also can effectively avoid the occurrence of ash deposition and coking in the burner body and the furnace.

In some embodiments, the velocity of the outer secondary air is controlled in a range of 20 to 50 m/s.

In some embodiments, a ratio of the inner secondary air to the outer secondary air is 1:2, which cannot only ensure stable combustion of the pulverized coal and mix the inner secondary air layer by layer with the main flame to reduce nitrogen oxides, but also enable the outer secondary air close to the wall to have sufficient momentum to cool the combustion stabilizing chamber 5 and the flow smoothing chamber 6.

With the above technical solutions, the present disclosure has the following advantages. First, due to the inner secondary air guide tube and the outer secondary air guide tube, the air can be divided into the inner secondary air and the outer secondary air to enter the burner body separately, which supplies the air to the burner in a staged manner to decrease nitrogen oxides, and combines the inner secondary air with the transition channel to fully mix the pulverized coal and air and stabilize the combustion; moreover, the outer secondary air can form the cooling air layer flowing along the wall surface of the combustion stabilizing chamber in the combustion stabilizing chamber to cool the combustion stabilizing chamber and the flow smoothing chamber, so that the wall temperature of the combustion stabilizing chamber and the flow smoothing chamber is lower than 40° C., which cannot only omit any water cooling device of the combustion stabilizing chamber, but also avoid the occurrence of ash deposition and coking on the wall surface of the combustion stabilizing chamber. Second, in the present disclosure, a sectional area of the outer secondary air passage and hence a velocity of the outer secondary air can be adjusted by the movable positioning assembly, and a mixing rate of the inner secondary air and the outer secondary air is controlled, to control a combustion process of the pulverized coal airflow in the burner body, so that an environment with low oxygen and high temperature inside and with high oxygen and low temperature outside is formed in the combustion stabilizing chamber, and such temperature distribution and atmosphere distribution can achieve an effect of high combustion efficiency and low nitrogen, broaden a load regulation range of the burner, improve the adaptability to coal types, effectively solve high-temperature corrosion, ash deposition, coking and other phenomena on the wall surface of the combustion stabilizing chamber, lower the maintenance frequency of the burner, and prolong the service life of the burner. Third, in the present disclosure, the transition channel can be provided with a built-in ignition oil gun and igniter, but also can cooperate together with the inner secondary air passage having the built-in movable axial impeller to create a backflow zone with a high turbulence intensity, enhance the mixing rate of the pulverized coal and air, and improve the burnout rate of pulverized coal under low load conditions.

A specific structure of a multi-channel single-cone burner according to embodiments of the present disclosure will be described in detail below with reference to FIGS. 12-20.

Figure 12:
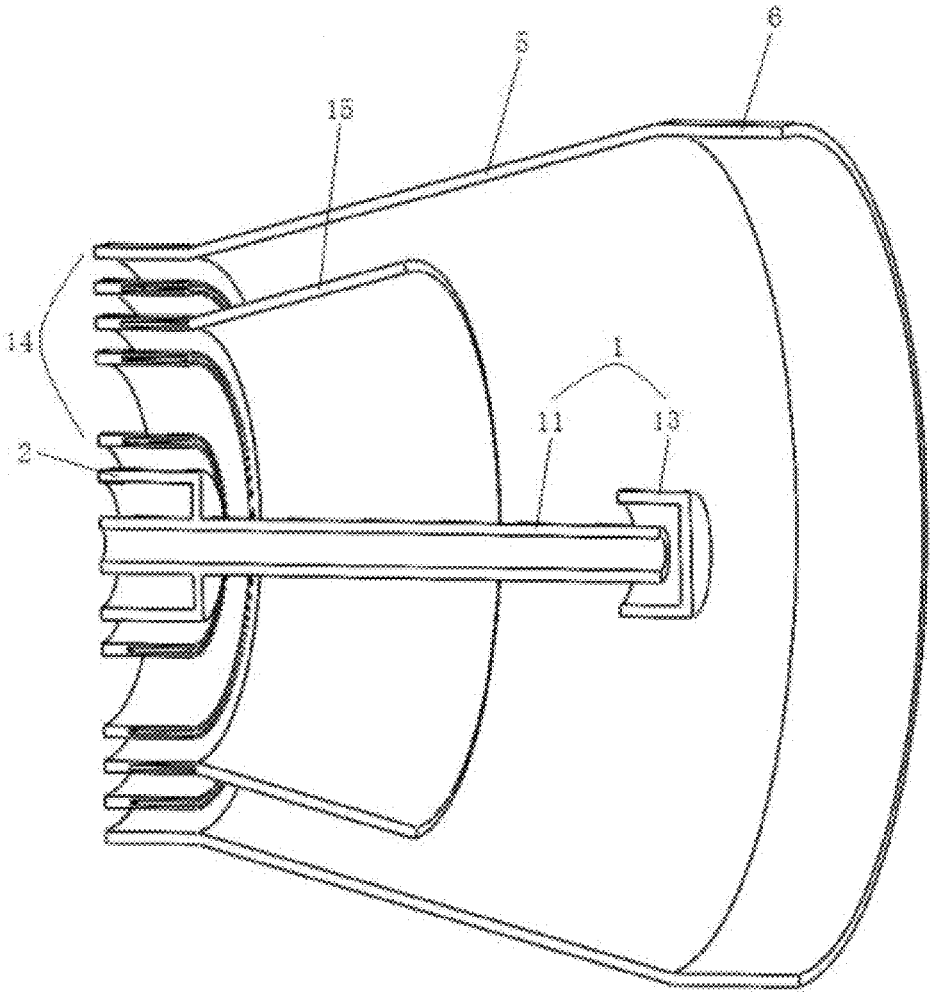
FIG. 12 is a three-dimensional longitudinal sectional view of a multi-channel single-cone burner according to an embodiment of the present disclosure.
Figure 13:
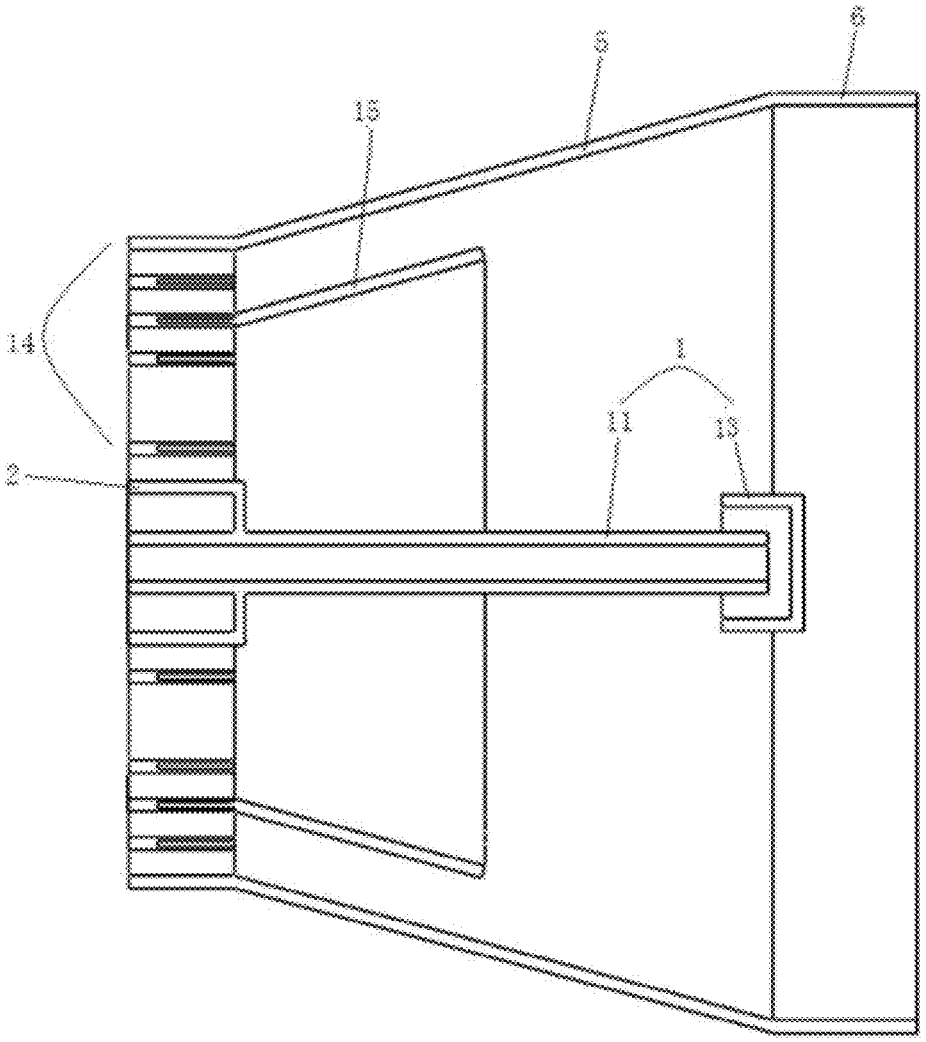
FIG. 13 is a two-dimensional longitudinal sectional view of a multi-channel single-cone burner according to an embodiment of the present disclosure.
Figure 14:
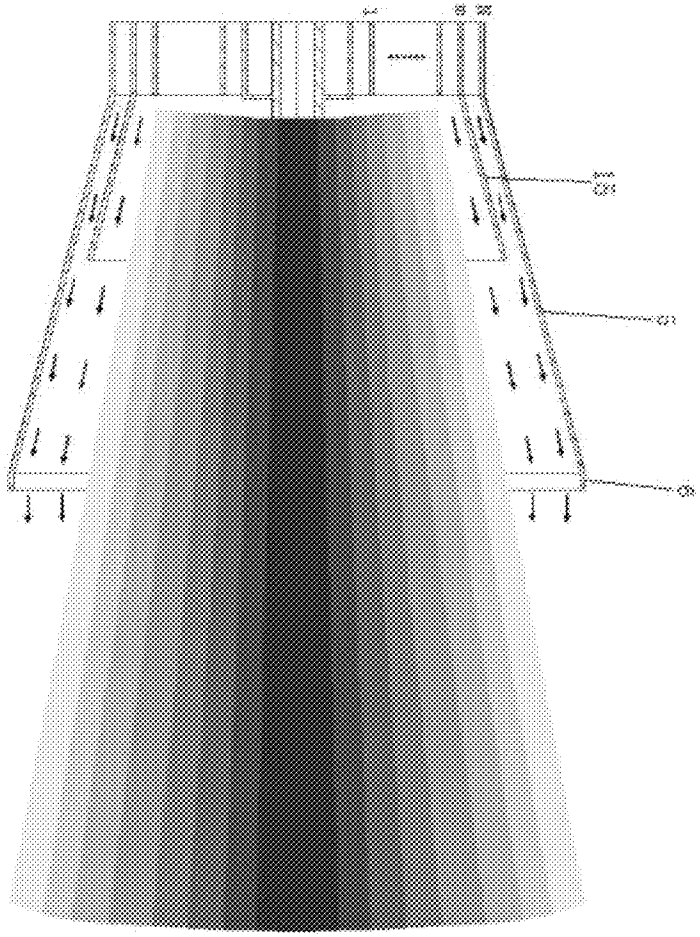
FIG. 14 is a schematic view of an internal flow field of a multi-channel single-cone burner according to an embodiment of the present disclosure.

As shown in FIG. 12 and FIG. 13, a multi-channel reverse-injection swirl single-cone burner according to the present disclosure includes a pulverized coal supply mechanism 1, a transition channel 2, a multi-stage air distribution assembly 14, a guide plate 15, a combustion stabilizing chamber 5, and a flow smoothing chamber 6. The multi-stage air distribution assembly 14 includes N air guide tubes (N is a natural number not less than two) arranged coaxially from inside to outside, of which the $N^{th}$ (outermost) air tube is connected to the combustion stabilizing chamber 5 and the flow smoothing chamber 6 sequentially to form the burner body. The pulverized coal supply mechanism 1 runs through an interior of the burner body, and the transition channel 2 is fitted over an inlet end of the pulverized coal supply mechanism 1. The first (innermost) air guide tube is fitted over and spaced apart from the transition channel 2. In such a way, a total of N air inlet channels are formed between every adjacent two air guide tubes and between the first air guide tube and the transition channel 2. Meanwhile, except for the $N^{th}$ air guide tube, each of the other air guide tubes has a double-layer hollow structure, i.e., an annular groove extending axially is on an inner side of each of the other air guide tubes, and a first end of at least one guide plate 15 can be inserted into the annular groove of the corresponding air guide tube and be fixed. Thus, at least one straight flow channel is formed between each guide plate 15 and the combustion stabilizing chamber 5, and a second end of each guide plate 15 is formed with a flared opening that has a same angle as the combustion stabilizing chamber 5, so that a direction of an outlet end of the straight flow channel is parallel to a wall surface of the combustion stabilizing chamber 5.

In some embodiments, radial widths of the N air inlet channels are different, so that corresponding air guide tubes can be selected and inserted into the guide plates 15 according to different coal types and loads, to control a mixing rate of air with the main flame, adjust the high-temperature backflow zone, and broaden the load regulation range of the burner and improves the adaptability to the coal types.

In some embodiments, the number of guide plates 15 is controlled from 1 to 4. When there are two or more than two guide plates 15, a length of the guide plate 15 on the inside is less than a length of the guide plate 15 on the outside.

In some embodiments, in case of coal with high volatility and high calorific value, the guide plate 15 can be lengthened and/or the number of the guide plates 15 can be increased, to delay the mixing time of combustion-supporting air (including rotating and straight airflows) with the main flame, enhance a reducing atmosphere in the main flame, and decrease nitrogen oxides; in case of coal with low volatility and low calorific value, the guide plate 15 can be shortened and/or the number of the guide plates 15 can be decreased (even the guide plate 15 may be omitted), to strengthen the mixing of the combustion-supporting air with the main flame, which is conducive to the ignition and stable combustion of the pulverized coal. Accordingly, the mixing rate of air and the main flame can be controlled mechanically by adjusting the length and quantity of the guide plate 15, and the load regulation range can reach 10%-110%.

In some embodiments, an axial impeller (not shown in the drawings) is mounted along the peripheral direction in the air inlet channel on an inner side of the guide plate 15, so that air passes through the axial impeller and forms a rotating airflow with a tangential velocity.

In some embodiments, the swirling number of the rotating airflow generated by the axial impeller is controlled in a range of 0.6 to 2.

In some embodiments, the pulverized coal supply mechanism 1 mainly includes an air-pulverized coal duct 11 and a backflow cap 13; the air-pulverized coal duct 11 is on a central axis of the burner body; and the backflow cap 13 is at an outlet end of the air-pulverized coal duct 11 and in an outlet section of the combustion stabilizing chamber 5.

Figure 15:
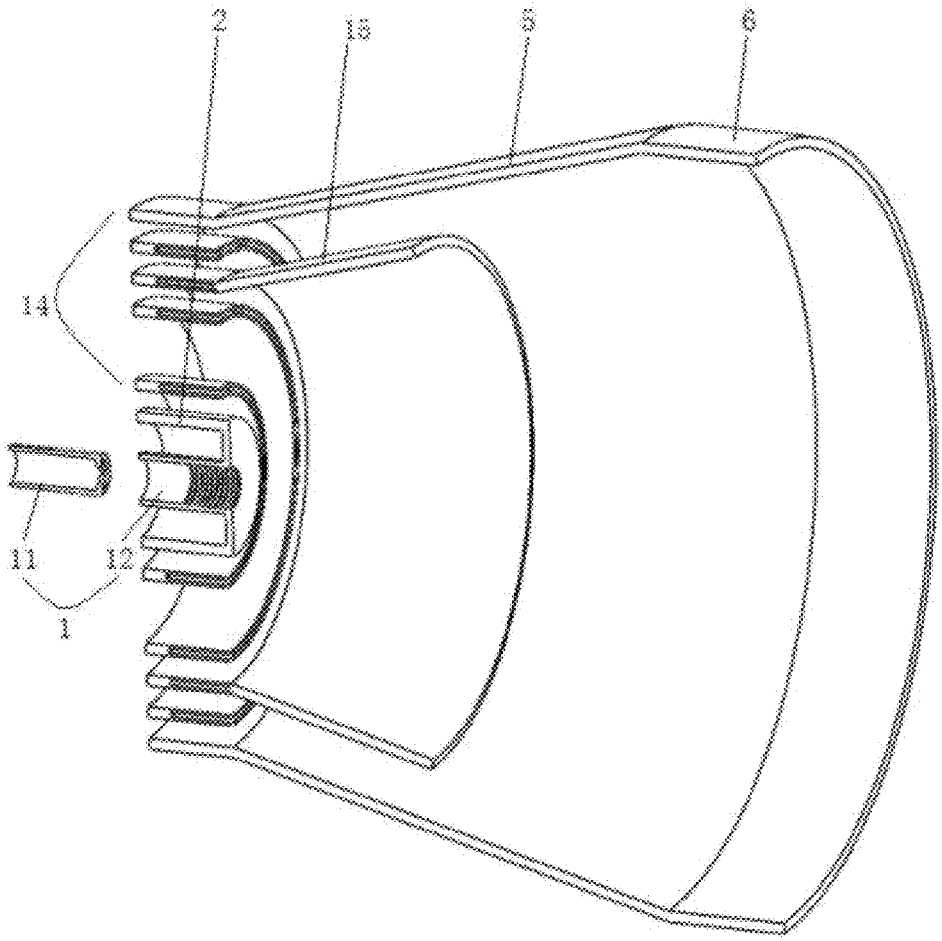
FIG. 15 is a three-dimensional longitudinal sectional view of a multi-channel single-cone burner according to another embodiment of the present disclosure.
Figure 16:
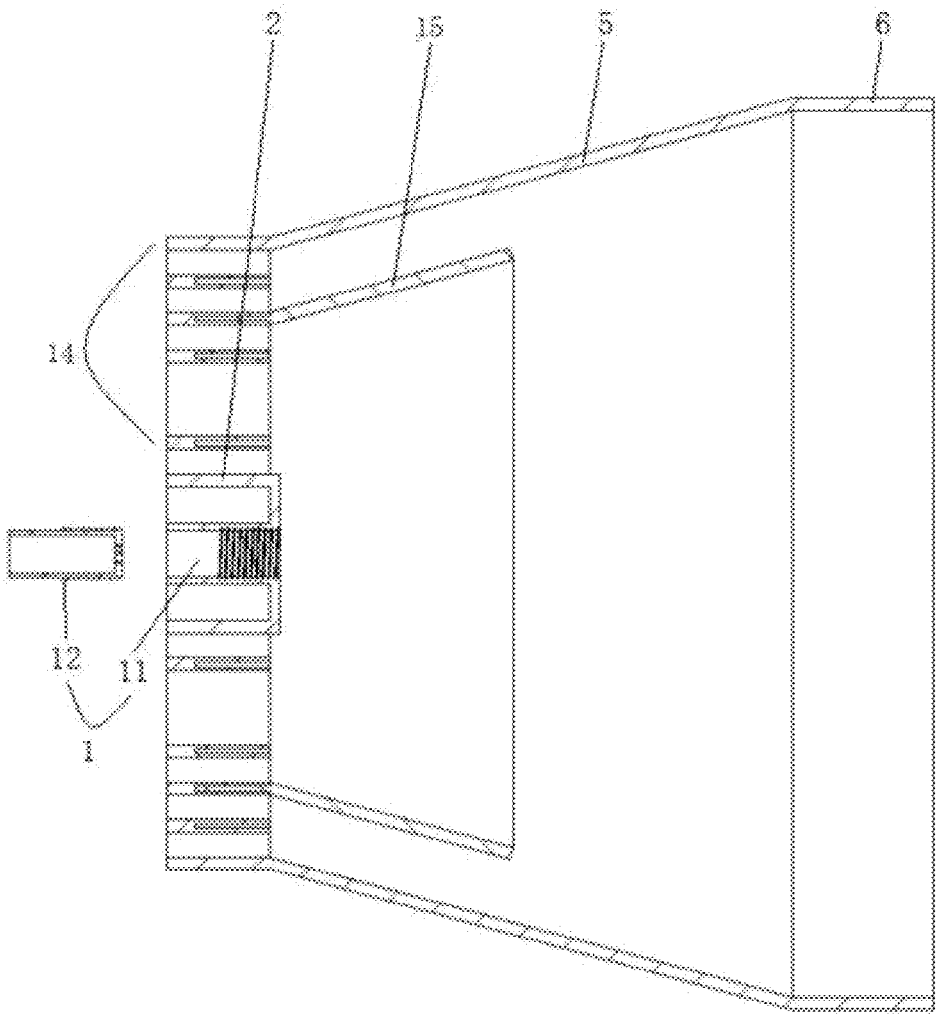
FIG. 16 is a two-dimensional longitudinal sectional view of a multi-channel single-cone burner according to another embodiment of the present disclosure.

Further, the structure of the pulverized coal supply mechanism 1 is not limited to that shown in FIG. 12. For example, as shown in FIG. 15, the pulverized coal supply mechanism 1 includes the air-pulverized coal duct 11 and a rich/lean separator 12; the air-pulverized coal duct 11 is on the central axis of the burner body and in connection with the combustion stabilizing chamber 5; the rich/lean separator 12 is detachably connected to the air-pulverized coal duct 11 to make the pulverized coal fed into the combustion stabilizing chamber 5 present an inner rich and outer lean concentration distribution or an inner lean and outer rich concentration distribution.

Figure 17:
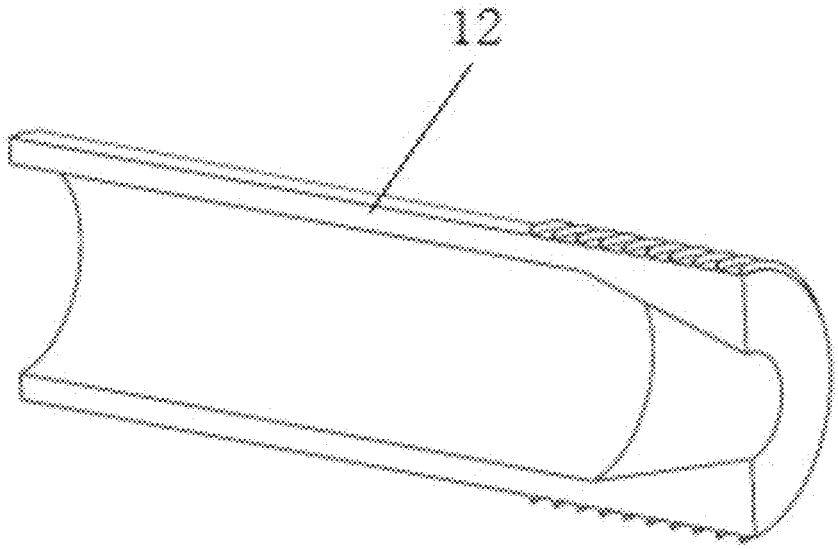
FIG. 17 is a schematic view of a throat-type rich/lean separator of a multi-channel single-cone burner according to an embodiment of the present disclosure.
Figure 18:
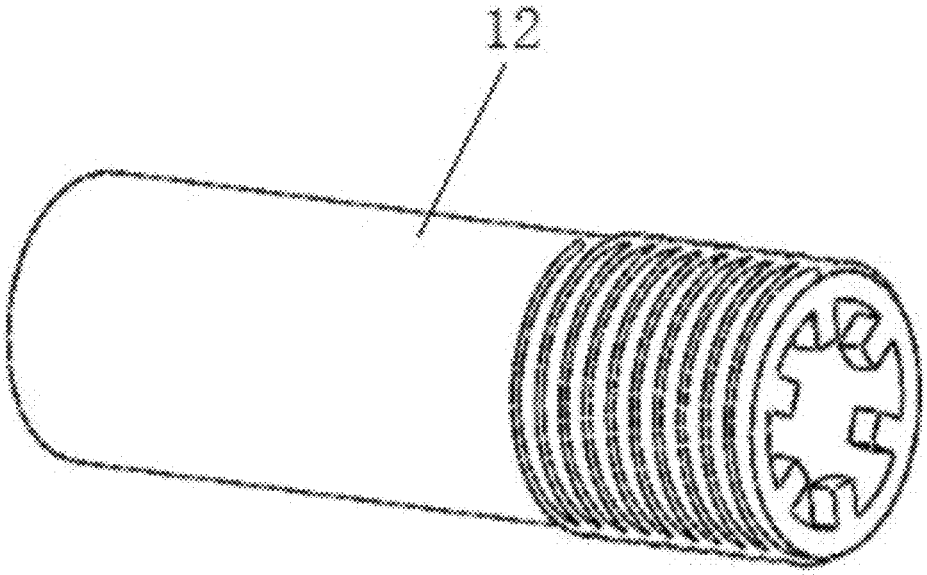
FIG. 18 is a schematic view of a gear-type rich/lean separator of a multi-channel single-cone burner according to an embodiment of the present disclosure.
Figure 19:
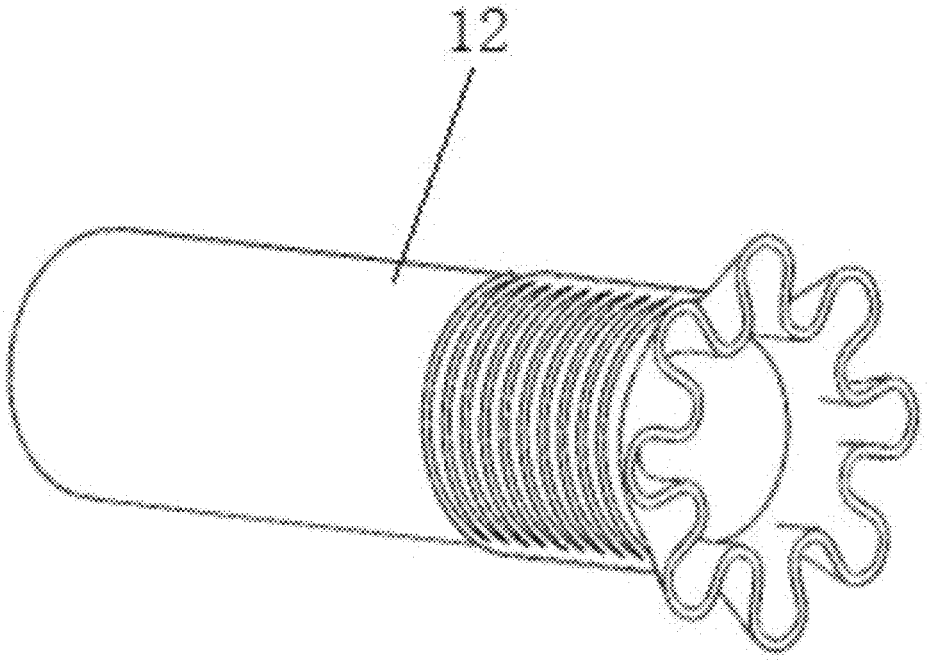
FIG. 19 is a schematic view of a petal-shaped rich/lean separator of a multi-channel single-cone burner according to an embodiment of the present disclosure.
Figure 20:
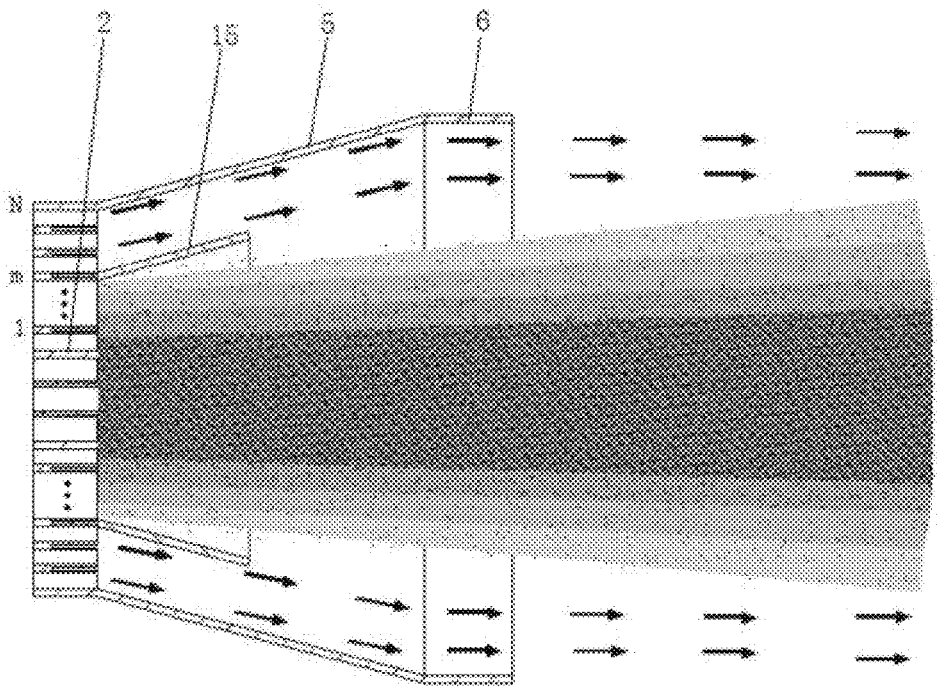
FIG. 20 is a schematic view of an internal flow field of a multi-channel single-cone burner according to an embodiment of the present disclosure.

In some embodiments, the rich/lean separator 12 may be a throat-type rich/lean separator (as shown in FIG. 17), a gear-type rich/lean separator (as shown in FIG. 18), or a petal-shaped rich/lean separator (as shown in FIG. 19). An external thread is formed on an outer wall of the rich/lean separator 12, and an internal thread is formed on an inner wall of an outlet section of the air-pulverized coal duct 11. The rich/lean separator 12 can be inserted into the air-pulverized coal duct 11 through the outlet end of the air-pulverized coal duct 11 and threadedly connected to the air-pulverized coal duct 11. Consequently, the rich/lean separator 12 can be replaced correspondingly according to coal types, which broadens a load regulation range of the burner and improves the adaptability to the coal types.

In some embodiments, the transition channel 2 is a cylindrical structure with an open end and a closed end; the air-pulverized coal duct 11 penetrates the closed end of the transition channel 2 and then extends into the burner body; an igniter and/or a flame detector (not shown in the drawings) can be mounted in the transition channel 2.

In some embodiments, the transition channel 2 is conical, elliptical, cylindrical or any other curved bluff body, and the widest diameter of the transition channel 2 is smaller than an inner diameter of the first air guide tube and the narrowest diameter greater thereof is greater than a maximum diameter of the igniter and/or the flame detector.

When the pulverized coal supply mechanism 1 mainly includes the air-pulverized coal duct 11 and the backflow cap 13, the workflow of the multi-channel single-cone burner according to the present disclosure during use is presented as follows.

1) The length and number of the guide plates 15 are determined according to a coal type, and the guide plates 15 are inserted into corresponding air guide tubes. A position where the innermost guide plate 15 is located is denoted as the $m^{th}$ air guide tube, and axial impellers are mounted along the peripheral direction in the $1^{st}$ to $m^{th}$ air inlet channels.
2) Air is divided into N strands by the multi-stage air distribution assembly 14 and then enters the burner body, in which the $1^{st}$ to $m^{th}$ strands of air pass through the axial impeller and form m strands of rotating air with a tangential velocity. The m strands of rotating air enter the combustion stabilizing chamber 5, and interact with each other to form a multi-layer nested high-temperature backflow zone.
3) Meanwhile, an airflow entrained with pulverized coal enters the high-temperature backflow zone through a backflow passage formed by the air-pulverized coal duct 11 and the backflow cap 13, and the pulverized coal presents an inner lean and outer rich concentration distribution. The pulverized coal is preheated to 900-1000° C. through the high-temperature backflow zone. The pulverized coal is pyrolyzed in the low-oxygen and hot high-temperature backflow zone and is mixed with the strands of air under a joint action of the transition channel 2 to form a multi-layer main flame.

4) The $(m+1)^{th}$~$N^{th}$ air inlet channels form straight flow channels. After passing through each straight flow channel, the $(m+1)^{th}$~$N^{th}$ strands of air form straight airflows with different velocities (the velocities sequentially decrease from outside to inside). The straight airflow has two functions. The first function is that the straight airflow forms a cooling air layer flowing along the wall surface of the combustion stabilizing chamber 5 after passing through the flared opening of the guide plate 15, to cool the combustion stabilizing chamber 5 and the flow smoothing chamber 6, so that a wall temperature of the combustion stabilizing chamber 5 and the flow smoothing chamber 6 is lower than 40° C. The second function is that the straight airflow and the main flame form a high-speed jet flame wrapped in air, by the flow smoothing chamber 6, and the high-speed jet flame enters the furnace, which not only stabilizes the combustion of the pulverized coal, but also avoids the occurrence of ash deposition and coking in the burner body and the furnace.

When the pulverized coal supply mechanism 1 mainly includes the air-pulverized coal duct 11 and the rich/lean separator 12, the workflow of the multi-channel single-cone burner according to the present disclosure during use is presented as follows.

1) A corresponding rich/lean separator 12 is selected and mounted on the air-pulverized coal duct 11 according to a coal type. Meanwhile, the length and number of the guide plates 15 are determined according to the coal type, and the guide plates 15 are inserted into corresponding air guide tubes. A position where the innermost guide plate 15 is located is denoted as the $m^{th}$ air guide tube, and axial impellers (not shown in the drawings) are mounted along the peripheral direction in the $1^{st}$ to $m^{th}$ air inlet channels.

2) Air is divided into N strands by the multi-stage air distribution assembly 14 and then enters the burner body, in which the $1^{st}$ to $m^{th}$ strands of air pass through the axial impeller and form m strands of rotating air with a tangential velocity. The m strands of rotating air enter the combustion stabilizing chamber 5, and interact with each other to form a multi-layer nested high-temperature backflow zone.

3) Meanwhile, an airflow entrained with pulverized coal is injected into the combustion stabilizing chamber 5 through the air-pulverized coal duct 11 and the rich/lean separator 12. The pulverized coal presents an inner rich and outer lean concentration distribution or an inner lean and outer rich concentration distribution. The pulverized coal is preheated to 900-1000° C. through the high-temperature backflow zone. The pulverized coal is pyrolyzed in the low-oxygen and hot high-temperature backflow zone and is mixed with the strands of air under a joint action of the transition channel 2 to form a multi-layer main flame.

4) The $(m+1)^{th}$~$N^{th}$ air inlet channels form straight flow channels. After passing through each straight flow channel, the $(m+1)^{th}$~$N^{th}$ strands of air form straight airflows with different velocities (the velocities sequentially decrease from outside to inside). The straight airflow has two functions. The first function is that the straight airflow forms a cooling air layer flowing along the wall surface of the combustion stabilizing chamber 5 after passing through the flared opening of the guide plate 15, to cool the combustion stabilizing chamber 5 and the flow smoothing chamber 6, so that a wall temperature of the combustion stabilizing chamber 5 and the flow smoothing chamber 6 is lower than 40° C. The second function is that the straight airflow and the main flame form a high-speed jet flame wrapped in air, by the flow smoothing chamber 6, and the high-speed jet flame enters the furnace, which not only stabilizes the combustion of the pulverized coal, but also avoids the occurrence of ash deposition and coking in the burner body and the furnace.

In some embodiments, in the above step 1), in case of coal with high volatility and high calorific value, a throat-type rich/lean separator or a gear-type rich/lean separator is selected as the rich/lean separator 12, to produce an inner rich and outer lean concentration distribution of the pulverized coal, and enhance the rigidity of the main flame, thus increasing a flame length of the main flame, which is beneficial to improving combustion efficiency and reducing nitrogen oxide emissions; in case of coal with low volatility and low calorific value, a petal-shaped rich/lean separator is selected as the rich/lean separator 12, so that an inner lean and outer rich concentration distribution of the pulverized coal is produced, and several small high-temperature flue gas return zones are formed near an outlet of the petal-shaped rich/lean separator, which is helpful for the ignition and stable combustion of the pulverized coal.

In some embodiments, a velocity of the straight airflow should be controlled in a range of 30 to 50 m/s.

With the above technical solutions, the present disclosure has the following advantages. First, since the present disclosure adopts the design of the multi-stage air distribution assembly, the air is divided into N strands by the multi-stage air distribution assembly and enters the burner body, and the turbulence intensity at a boundary of the airflow is strong, which strengthens the mixing rate of air and pulverized coal, makes the pulverized coal ignite stably, and ensures the efficient and low nitrogen combustion of the pulverized coal. Second, the multi-stage air distribution assembly of the present disclosure is composed of a plurality of air guide tubes arranged coaxially from the inside to the outside, the air guide tube adopts a double-layer hollow structure, and the guide plate can be inserted into the double-layer hollow structure of any air guide tube, so that a multi-layer flame structure with cooling air close to the wall surfaces of the combustion stabilizing chamber and the flow smoothing chamber can be formed, and combustion supporting air slowly penetrates into the main flame, to ensure a high temperature, high CO and low oxygen environment in the center of the main flame, and prolong the pulverized coal's exposure to a high-temperature reducing atmosphere, achieving a purpose of high combustion efficiency and low nitrogen; meanwhile, the straight airflow formed between the guide plate and the combustion stabilizing chamber can form the cooling air layer flowing along the wall surface of the combustion stabilizing chamber in the combustion stabilizing chamber to cool the combustion stabilizing chamber and the flow smoothing chamber, so that the wall temperature of the combustion stabilizing chamber and the flow smoothing chamber is always lower than 40° C., which cannot only omit any water cooling device of the combustion stabilizing chamber, but also avoid the occurrence of ash deposition and coking on the wall surface of the combustion stabilizing chamber. Third, in the present disclosure, the mixing rate of the combustion supporting air and main flame can be controlled mechanically by adjusting the length and quantity of the guide plates, the load regulation range is from 10% to 110%, which is a very wide load adjustment range, and the present disclosure has characteristics of a wide load regulation range, stable combustion and low nitrogen. Fourth, in the present disclosure, the transition channel can be provided with a built-in ignition oil gun and igniter, but also can cooperate together with the inner secondary air passage having the built-in movable axial impeller to create a backflow zone with a high turbulence intensity, enhance the mixing rate of the pulverized coal and air, and improve the burnout rate of pulverized coal under low load conditions.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example. Furthermore, the particular features, structures, materials, or characteristics may be combined in any suitable manner in one or more embodiments or examples. Moreover, different embodiments or examples as well as features in different embodiments or examples described in this specification may be combined and united by those skilled in the art in case of no mutual contradiction.

In this specification, the term "a plurality of" means at least two, such as two or three, unless specified otherwise.

In the present disclosure, unless specified or limited otherwise, terms "mounted," "connected," "coupled," "fixed" and the like are used broadly, and may be, for example, fixed connections, detachable connections, or integral connections; may also be mechanical connections; may also be electrical connections or communicate with each other; may also be direct connections or indirect connections via intervening structures; may also be inner connection or mutual interaction of two elements, which can be understood by those skilled in the art according to specific situations.

In addition, terms such as "first" and "second" are used herein for purposes of description and are not intended to indicate or imply relative importance or to imply the number of indicated technical features. Thus, the feature defined with "first" and "second" may include one or more of this feature.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Although embodiments have been shown and described above, it would be appreciated by those skilled in the art that the above embodiments are exemplary and cannot be construed to limit the present disclosure, and changes, modifications, alternatives and variations can be made in the embodiments without departing from the scope of the present disclosure.

The invention claimed is:

1. A two-channel burner, comprising: a pulverized coal supply mechanism, a transition channel, an inner secondary air guide tube, an outer secondary air guide tube, a combustion stabilizing chamber and a flow smoothing chamber, wherein:

the outer secondary air guide tube, the combustion stabilizing chamber and the flow smoothing chamber are sequentially connected to form a burner body, the pulverized coal supply mechanism runs through the burner body, and the transition channel is fitted over an inlet end of the pulverized coal supply mechanism;

the inner secondary air guide tube is arranged between the transition channel and the outer secondary air guide tube, an inner secondary air passage is formed between the inner secondary air guide tube and the transition channel, and an outer secondary air passage is formed between the inner secondary air guide tube and the outer secondary air guide tube; and an outlet end of the inner secondary air guide tube forms a flared opening, the flared opening has a same angle as the combustion stabilizing chamber, and a direction of an outlet end of the inner secondary air passage is parallel to a wall surface of the combustion stabilizing chamber.

2. The two-channel burner according to claim 1, wherein a movable axial impeller assembly is arranged in the inner secondary air passage, to enable inner secondary air to pass through the movable axial impeller assembly and form a rotating airflow with a tangential velocity.

3. The two-channel burner according to claim 2, wherein the movable axial impeller assembly comprises:

an axial impeller arranged in the inner secondary air passage along a peripheral direction and movable in an axial direction;

an adjustable telescopic pull rod having a first end connected to the axial impeller through a first hinge joint; and a locking pull rod connected to a second end of the adjustable telescopic pull rod through a second hinge joint.

4. The two-channel burner according to claim 3, wherein a swirling number of the rotating airflow generated by the movable axial impeller assembly should be is controlled in a range of 0 to 2.

5. The two-channel burner according to claim 1, wherein the inner secondary air guide tube and the outer secondary air guide tube are connected by several movable positioning assemblies distributed along a peripheral direction, and the movable positioning assemblies are configured to adjust a sectional area of the outer secondary air passage.

6. The two-channel burner according to claim 5, wherein:

there are several threaded holes in an upper edge of the inner secondary air guide tube along the peripheral direction and several smooth holes in an upper edge of the outer secondary air guide tube along the peripheral direction, and the outer secondary air guide tube has a flexible tube wall; and the movable positioning assembly mainly comprises an adjusting bolt and a sealing washer, and the adjusting bolt is threaded to the threaded hole of the inner secondary air guide tube after passing through the sealing washer and the smooth hole of the outer secondary air guide tube.

7. The two-channel burner according to claim 6, wherein a velocity of outer secondary air is controlled in a range of 20 to 50 m/s, and a ratio of inner secondary air to the outer secondary air is 1:2.

8. The two-channel burner according to claim 1, wherein:

the pulverized coal supply mechanism comprises an air-pulverized coal duct and a backflow cap; the air-pulverized coal duct is on a central axis of the burner body; and the backflow cap is at an outlet end of the air-pulverized coal duct and in an outlet section of the combustion stabilizing chamber; and several through-holes are provided in the combustion stabilizing chamber.

9. The two-channel burner according to claim 1, wherein the pulverized coal supply mechanism comprises an air-pulverized coal duct and a rich/lean separator; the air-pulverized coal duct is on a central axis of the burner body and in connection with the combustion stabilizing chamber; and the rich/lean separator is detachably connected to the air-pulverized coal duct to make pulverized coal fed into the combustion stabilizing chamber present an inner rich and outer lean concentration distribution or an inner lean and outer rich concentration distribution.

10. The two-channel burner according to claim 9, wherein the rich/lean separator is a throat-type rich/lean separator, a gear-type rich/lean separator, or a petal-shaped rich/lean separator; an external thread is formed on an outer wall of the rich/lean separator, and an internal thread is formed on an inner wall of an outlet section of the air-pulverized coal duct; and the rich/lean separator is inserted into the air-pulverized coal duct through an outlet end of the air-pulverized coal duct and threadedly connected to the air-pulverized coal duct.

11. The two-channel burner according to claim 8, wherein the transition channel is a cylindrical structure with an open end and a closed end; the air-pulverized coal duct penetrates the closed end of the transition channel and extends into the burner body; at least one of an igniter and a flame detector is mounted in the transition channel; and the transition channel is conical, elliptical, cylindrical or any other curved bluff body, and a widest diameter of the transition channel is smaller than an inner diameter of the inner secondary air guide tube and a narrowest diameter greater of the transition channel is greater than a maximum diameter of the at least one of the igniter and the flame detector.

12. A method for using a two-channel burner, wherein the two-channel burner comprises a pulverized coal supply mechanism, a transition channel, an inner secondary air guide tube, an outer secondary air guide tube, a combustion stabilizing chamber and a flow smoothing chamber;

the outer secondary air guide tube, the combustion stabilizing chamber and the flow smoothing chamber are sequentially connected to form a burner body, the pulverized coal supply mechanism runs through the burner body, and the transition channel is fitted over an inlet end of the pulverized coal supply mechanism;

the inner secondary air guide tube is arranged between the transition channel and the outer secondary air guide tube, an inner secondary air passage is formed between the inner secondary air guide tube and the transition channel, and an outer secondary air passage is formed between the inner secondary air guide tube and the outer secondary air guide tube;

an outlet end of the inner secondary air guide tube forms a flared opening, the flared opening has a same angle as the combustion stabilizing chamber, and a direction of an outlet end of the inner secondary air passage is parallel to a wall surface of the combustion stabilizing chamber; and the pulverized coal supply mechanism comprises an air-pulverized coal duct and a rich/lean separator, the air-pulverized coal duct is on a central axis of the burner body and in connection with the combustion stabilizing chamber, and the rich/lean separator is detachably connected to the air-pulverized coal duct to make pulverized coal fed into the combustion stabilizing chamber present an inner rich and outer lean concentration distribution or an inner lean and outer rich concentration distribution;

wherein the method comprises:

step (1): a corresponding rich/lean separator is selected and mounted on the air-pulverized coal duct according to a coal type;

step (2): air enters the burner body in two ways, one of which passes through a movable axial impeller assembly and the inner secondary air passage, so that rotating inner secondary air with a tangential velocity is formed and directly enters the combustion stabilizing chamber, and the inner secondary air passage and the transition channel work together to form a nested high-temperature backflow zone;

step (3): meanwhile, an airflow entrained with pulverized coal is injected into the combustion stabilizing chamber through the air-pulverized coal duct and the rich/lean separator, the pulverized coal presents an inner rich and outer lean concentration distribution or an inner lean and outer rich concentration distribution, the pulverized coal is preheated to 900-1000° C. through the high-temperature backflow zone, and the pulverized coal is pyrolyzed in the low-oxygen and hot high-temperature backflow zone and is mixed with the inner secondary to form a main flame; and step (4): the other way passes through the outer secondary air passage, to form outer secondary air; a part of the outer secondary air passes through the flared opening of the outer secondary air guide tube and forms a cooling air layer flowing along the wall surface of the combustion stabilizing chamber to cool the combustion stabilizing chamber and the flow smoothing chamber; and another part of the outer secondary air and the main flame form a high-speed jet flame wrapped in air, by the flow smoothing chamber, and the high-speed jet flame enters a furnace.

13. The method according to claim 12, wherein in the step, in case of coal with high volatility and high calorific value, a throat-type rich/lean separator or a gear-type rich/lean separator is selected as the rich/lean separator; and in case of coal with low volatility and low calorific value, a petal-shaped rich/lean separator is selected as the rich/lean separator.

14. The method according to claim 12, wherein in the above steps, a sectional area of the outer secondary air passage is adjusted by a movable positioning assembly, to regulate a velocity of the outer secondary air and control a mixing rate of the inner secondary air and the outer secondary air.

15. A multi-channel single-cone burner, comprising a pulverized coal supply mechanism, a transition channel, a multi-stage air distribution assembly, a guide plate, a combustion stabilizing chamber, and a flow smoothing chamber, wherein:

the multi-stage air distribution assembly comprises N air guide tubes arranged coaxially from inside to outside, and N is a natural number not less than two, wherein an $N^{th}$ air tube is connected to the combustion stabilizing chamber and the flow smoothing chamber sequentially to form a burner body, the pulverized coal supply mechanism runs through an interior of the burner body, the transition channel is fitted over an inlet end of the pulverized coal supply mechanism, and a first air guide tube is fitted over and spaced apart from the transition channel, so that a total of N air inlet channels are formed between every adjacent two air guide tubes and between the first air guide tube and the transition channel;

meanwhile, except for the $N^{th}$ air guide tube, each of the other air guide tubes has a double-layer hollow structure, an annular groove extending axially is on an inner side of each of the other air guide tubes, and a first end of at least one guide plate is inserted into the annular groove of the corresponding air guide tube and is fixed; and at least one straight flow channel is formed between each guide plate and the combustion stabilizing chamber, and a second end of each guide plate is formed with a flared opening that has a same angle as the combustion stabilizing chamber, so that a direction of an outlet end of the straight flow channel is parallel to a wall surface of the combustion stabilizing chamber.

16. The multi-channel single-cone burner according to claim 15, wherein radial widths of the N air inlet channels are different, and corresponding air guide tubes are selected and inserted into the guide plate according to different coal types and loads.

17. The multi-channel single-cone burner according to claim 15, wherein a number of guide plates is controlled from 1 to 4, and when there are two or more than two guide plates, a length of the guide plate on the inside is less than a length of the guide plate on the outside.

18. The multi-channel single-cone burner according to claim 17, wherein:

at least one of the length and the quantity of the guide plates is increased in case of coal with high volatility and high calorific value; and at least one of the length and the quantity of the guide plates is decreased in case of coal with low volatility and low calorific value.

19. The multi-channel single-cone burner according to claim 15, wherein an axial impeller is mounted along a peripheral direction in the air inlet channel on an inner side of the guide plate, so that air passes through the axial impeller and forms a rotating airflow with a tangential velocity.

20. The multi-channel single-cone burner according to claim 19, wherein a swirling number of the rotating airflow generated by the axial impeller is controlled in a range of 0.6 to 2.

* * * * *